US008111236B2

(12) United States Patent
Kimura

(10) Patent No.: US 8,111,236 B2
(45) Date of Patent: Feb. 7, 2012

(54) BACKLIGHT DRIVING DEVICE AND DISPLAY

(75) Inventor: Tomohiro Kimura, Kanagawa (JP)

(73) Assignee: Sony Corporation (JP)

( * ) Notice: Subject to any disclaimer, the term of this patent is extended or adjusted under 35 U.S.C. 154(b) by 954 days.

(21) Appl. No.: 12/148,648

(22) Filed: Apr. 21, 2008

(65) Prior Publication Data

US 2008/0266241 A1 Oct. 30, 2008

(30) Foreign Application Priority Data

Apr. 25, 2007 (JP) ..... P2007-115953

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS 7,612,758 B2 * 11/2009 Yang ..... 345/102
7,903,081 B2 * 3/2011 Jang et al. ..... 345/102
2004/0001076 A1 * 1/2004 Leng et al. ..... 345/690
2005/0057484 A1 * 3/2005 Diefenbaugh et al. ..... 345/102
2007/0001998 A1 * 1/2007 Smith et al. ..... 345/102
2009/0091528 A1 * 4/2009 Hong ..... 345/102

* cited by examiner

*Primary Examiner* — Chanh Nguyen
*Assistant Examiner* — Roy Rabindranath
(74) *Attorney, Agent, or Firm* — Lerner, David, Littenberg, Krumholz & Mentlik, LLP

(57) ABSTRACT

A backlight driving device for driving a backlight that illuminates a display panel is disclosed. The backlight driving device includes: a luminance data input device into which luminance data indicated by a video signal is entered; a drive signal-generating device configured to create a drive signal; a power supply device configured to supply electric power to the backlight according to the drive signal so as to drive the backlight; a video signal decision device configured to make a decision as to whether each value of the luminance data entered into the luminance data input device is smaller than a given value; and a thinning-out device configured to thin out components of the drive signal when the video signal decision device has determined that the value of the luminance data is smaller than the given value and supply the thinned drive signal to the power supply device.

7 Claims, 3 Drawing Sheets

BACKLIGHT DRIVING DEVICE AND DISPLAY

CROSS REFERENCES CROSS-REFERENCE TO RELATED APPLICATIONS

The present application claims priority from Japanese Patent Application No. JP 2007-115953, filed in the Japanese Patent Office on Apr. 25, 2007, the entire content of which is incorporated herein by reference.

BACKGROUND OF THE INVENTION

1. Field of the Invention

The present invention relates to a backlight driving device for driving a backlight that illuminates a display panel and to a display incorporating this backlight driving device.

2. Description of the Related Art

A liquid crystal display (LCD) has the advantage over a CRT display that its enclosure can be made thin. Because of this advantage, LCDs are widely used as displays for information technology devices (such as computers) and as TV receivers. Such a liquid crystal display has a backlight as its light source. The backlight illuminates the LCD panel from the rear.

In a related-art LCD, the luminance value of an image displayed on the LCD is controlled by supplying a drive signal as shown below to the backlight such that the backlight illuminates the panel. That is, in the related-art LCD, a drive signal is created. The drive signal is pulse width-modulated in such a way that the duty cycle increases with increasing the luminance value of the video signal. A voltage corresponding to the created drive signal is applied to the backlight, thus controlling the luminance value of the displayed image (see, JP-A-2004-252127 (patent reference 1)).

In this related-art LCD, in cases where no voltage is applied to the backlight for longer than a given period of time and thus the LCD is under low-temperature conditions, there is the possibility that even if the drive voltage is applied, the backlight is not driven and the panel is not illuminated due to dead band characteristics. Therefore, the backlight is driven according to a drive signal composed of a pulsed signal that is pulse width-modulated, for example, within a range where the duty cycle is kept at an effective value.

SUMMARY OF THE INVENTION

In the above-described related-art LCD, however, even where a video signal having a luminance value of 0 is displayed, the backlight may not be lit up due to the dead band characteristics of the backlight when the backlight is attempted to be driven by a pulsed signal having an effective duty cycle after that video signal is displayed. To prevent this, the backlight is driven by a drive signal having an effective duty cycle at every given period of time. Consequently, the power consumption is made larger than where no electric power is supplied to the backlight at all by setting the duty cycle to 0.

Accordingly, it is desirable to provide a backlight driving device for reducing the power consumption of a backlight, for example, when a video signal having an ineffective luminance value is outputted and displayed. It is also desirable to provide a liquid crystal display incorporating this backlight driving device.

One embodiment of the present invention provides a backlight driving device for driving a backlight that illuminates a display panel, the backlight driving device having: a luminance data input means into which luminance data indicated by a video signal to be displayed in the display panel is entered; a drive signal-generating means for creating a drive signal made of a signal which is pulse width-modulated so as to have a duty cycle that is effective over a whole period, based on values of the luminance data entered into the luminance data input means; a power supply means for supplying electric power to the backlight according to the drive signal created by the drive signal-generating means so as to drive the backlight; a video signal decision means for making a decision as to whether each value of the luminance data entered into the luminance data input means is smaller than a given value; and a thinning-out means for thinning out components of the drive signal created by the drive signal-generating means when the video signal decision means has determined that the value of the luminance data entered into the luminance data input means is smaller than the given value and supplying the thinned drive signal to the power supply means.

Another embodiment of the present invention provides a display device for displaying a video signal on a display panel, the display device having: a video signal-accepting means for accepting the video signal; a video processing means for displaying the video signal accepted by the video signal-accepting means onto the display panel; a backlight which illuminates the display panel; and a backlight driving means for driving the backlight. The backlight driving means has: a drive signal-generating means for creating a drive signal made of a signal which is pulse width-modulated so as to have a duty cycle that is effective over a whole period, based on values of the luminance data indicated by the video signal accepted by the video signal-accepting means; a power supply means for supplying electric power to the backlight according to the drive signal created by the drive signal-generating means so as to drive the backlight; a video signal decision means for making a decision as to whether each value of the luminance data accepted by the video data-accepting means is smaller than a given value; and a thinning-out means for thinning out components of the drive signal created by the drive signal-generating means when the video signal decision means has determined that the value of the luminance data accepted by the video signal-accepting means is smaller than the given value and supplying the thinned drive signal to the power supply means.

In the embodiments of the present invention, when it is determined that the value given by the entered luminance data is smaller than the given value, the pulses forming the drive signal are thinned out. The thinned drive signal is supplied to the power supply means and, therefore, it is possible to reduce the electric power consumed by the backlight when a video signal having an ineffective luminance value is outputted, even if such a circuit that produces a drive signal capable of modifying the period of the pulse width modulation and that will become a factor causing an increase in the scale of the driving circuit is not used.

DESCRIPTION OF THE PREFERRED EMBODIMENTS

The preferred embodiments of the present invention are hereinafter described in detail with reference to the drawings.

A liquid crystal display (LCD) to which an embodiment of the present invention is applied is one example of display device which receives an external video signal and displays the signal on an LCD. Specifically, the LCD is configured as shown in FIG. 1.

Figure 1:
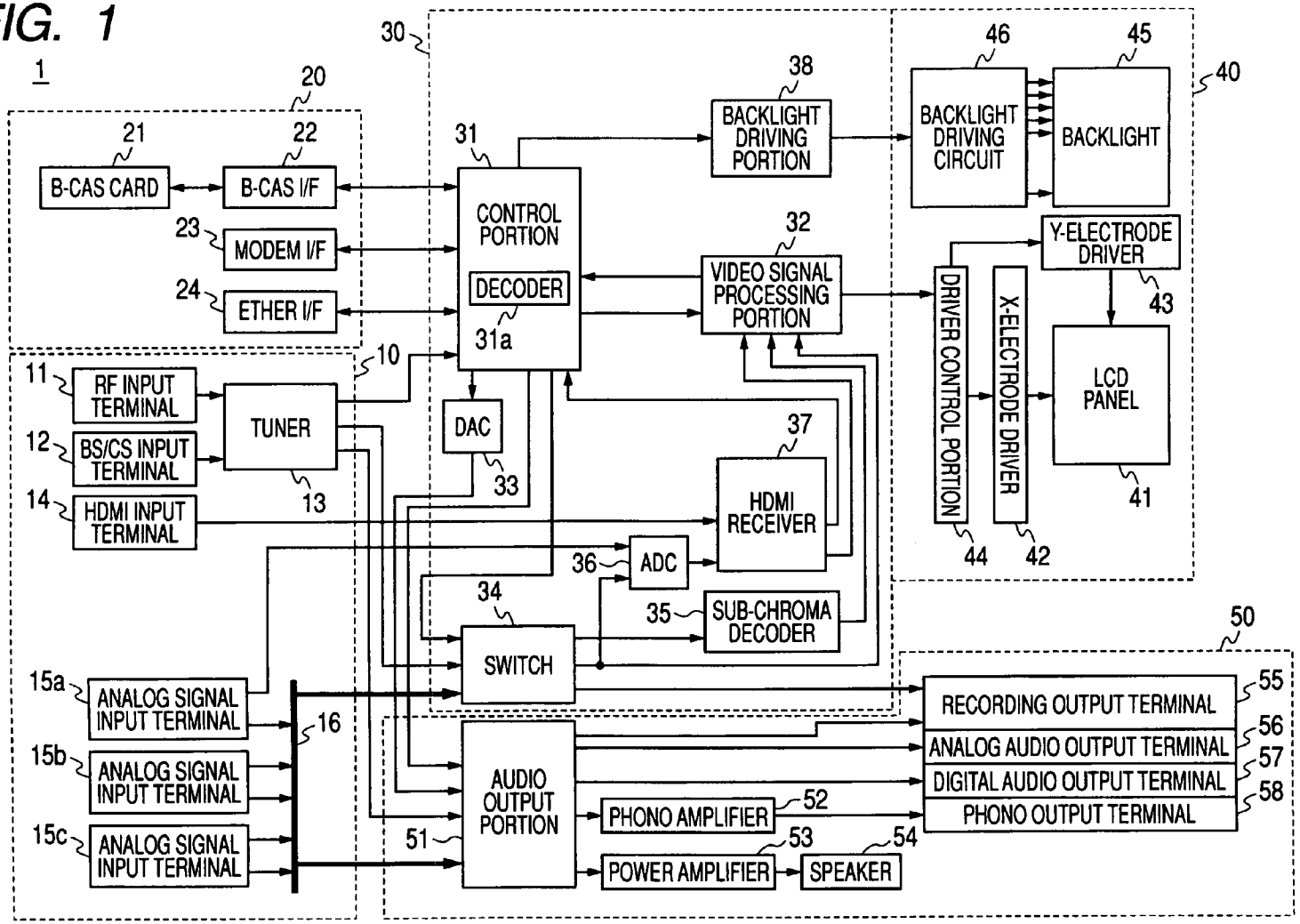
FIG. 1 is a block diagram showing one example of configuration of a liquid crystal display to which one embodiment of the present invention is applied.

As shown in FIG. 1, the liquid crystal display, generally indicated by reference numeral 1, has a signal input portion 10 for entering a video signal and an audio signal or TV signals from the outside, a data input portion 20 for entering control information about the display 1, an image processing portion 30 for receiving the video signal mainly from the signal input portion 10 and processing the video signal in a given manner, a display portion 40 for displaying the video signal, and a signal output portion 50 for outputting the video signal and audio signal to the outside.

The LCD 1 to which one embodiment of the present invention is applied achieves a reduction in electric power consumed by a backlight 45 equipped in the display portion 40 (described later). First, in the present embodiment, prior to description of the operation of the backlight 45, processing performed by the whole LCD 1 is described.

The signal input portion 10 has an RF input terminal 11 for receiving a signal of terrestrial digital broadcast airwaves received by an antenna (not shown), a BS/CS input terminal 12 for receiving the signal of satellite broadcast airwaves received by another antenna (not shown), a tuner 13 for receiving signals entered from the RF input terminal 11 and from the BS/CS input terminal 12, an HDMI input terminal 14 for entering HDMI (High-Definition Multimedia Interface) signals, plural analog signal input terminals 15*a*-15*c* for entering analog video signals, and a bus 16 to which analog signals entered from the analog input terminals 15*a*-15*c* are supplied.

The RF input terminal 11 is a connector terminal for receiving a terrestrial digital broadcast signal received by the antenna (not shown). The terminal 11 supplies the entered signal to the tuner 13.

The BS/CS input terminal 12 is a connector terminal for receiving satellite broadcast airwave signals received by the antenna (not shown). The input terminal 12 supplies the received signal to the tuner 13.

The tuner 13 receives signals entered from the RF input terminal 11 and from the BS/CS input terminal 12, demodulates the received signals, and supplies digital TV signal, analog video signal, and analog audio signal to the image processing portion 30. The tuner 13 may demodulate the received analog airwaves. Consequently, the analog video signal and analog audio signal are outputted to the tuner 13 when the received signals such as analog terrestrial broadcast waves and analog satellite broadcast waves are demodulated.

The HDMI input terminal 14 receives an HDMI signal in which a digital video signal, a digital audio signal, and a control signal have been multiplied. The input terminal 14 supplies the entered signal to the image processing portion 30.

The analog signal input terminals 15*a*-15*c* receive analog video signals each made up of an analog video signal and an analog audio signal. For example, the analog video signal entered into the analog signal input terminals 15*a*-15*c* is supplied to the image processing portion 30 via the bus 16. The analog audio signal is supplied to the signal output portion 50. The analog video signal entered from the analog signal input terminal 15*a* is directly supplied to the image processing portion 30 without via the bus 16.

The data input portion 20 has a B-CAS card 21, a B-CAS interface 22 connected with the B-CAS card 21, a modem interface 23 connected with a modem (not shown), and an Ethernet interface 24 connected with a local area network. Encryptic key information for decrypting encrypted information contained in the received broadcast airwaves encrypted by a conditional access system (such as a B-CAS system) is recorded on the B-CAS card 21.

Encryptic key information for decrypting encrypted information contained in the received broadcast airwaves encrypted by a conditional access system (such as a B-CAS system) is recorded on the B-CAS card 21.

The B-CAS interface 22 is an interface for entering encryptic key information recorded on the B-CAS card 21. The interface 22 supplies the entered encryptic key information to the image processing portion 30.

The modem interface 23 is an interface connected, for example, with an ADSL modem and sends and receives given data to and from the Internet network.

The Ethernet interface 24 is an interface for performing communications with other information processor, for example, via a local area network.

The image processing portion 30 has a control portion 31 for controlling the whole processing about the LCD 1, a video signal processing portion 32 for performing given processing on a video signal and outputting the processed signal to the display portion 40, a digital-to-analog converter (DAC) 33 for converting a digital audio signal outputted from the control portion 31 into an analog audio signal, a switch 34 for distributing plural video signals from the signal input portion 10 to various processing portions, a sub-chroma decoder 35 for performing given processing on analog color-difference video signals and converting the video signals into digital video signals, an analog-to-digital converter (ADC) 36 for converting an analog video signal into a digital video signal, an HDMI receiver 37 for receiving an HDMI signal, separating it into a digital video signal and a digital audio signal, and outputting these signals, and a backlight driving portion 38 for controlling the operation of a backlight driving circuit 46 of the display portion 40 (described later).

The control portion 31 is a processing portion for controlling the overall processing of the LCD 1. In particular, the control portion is realized by a processor having the following functions.

As a first function, the control portion 31 is equipped with a decoder 31*a* for separating a digital TV signal supplied from the tuner 13 into a digital video signal and a digital audio signal. The decoder 31*a* supplies the demodulated digital video signal to the video signal-processing portion 32. The decoder also supplies the demodulated digital audio signal to the digital-to-analog converter (DAC) 33. The decoder 31*a* converts the demodulated digital video signal into an analog video signal and supplies the resulting analog video signal to the switch 34.

When the digital TV signal is encrypted with a B-CAS system, the decoder 31*a* decrypts the signal based on the encryptic key information supplied from the B-CAS interface 22, thus demodulating the signal into descrambled digital video and audio signals.

As a second function, the control portion 31 controls the operation of the backlight driving portion 38. This processing will be described later.

The control portion 31 implements functions other than the first and second functions. In particular, the control portion performs processing for making reservations for recordings of TV programs. Furthermore, the control portion performs processing for supplying given electric power to various processing portions.

The video signal processing portion 32 converts the digital video signal demodulated by the decoder 31*a* of the control portion 31 into three color signals synchronized among the three primary colors of light, and supplies the color signals to the display portion 40. The video signal-processing portion 32 performs processing for converting an interlaced video signal into a progressive video signal. Furthermore, the video signal-processing portion 32 supplies luminance information included in the video signal to the control portion 31. The video signal processing portion 32 performs conversion processing regarding the color signals on digital video signal supplied from the sub-chroma decoder 35 (described later) and HDMI receiver 37 and on the analog video signal supplied from the switch 34, as well as on color signals supplied from the decoder 31*a*. The converted color signals are supplied to the display portion 40.

The digital-to-analog converter 33 converts the digital audio signal demodulated by the decoder 31*a* of the control portion 31 into an analog audio signal, and supplies the converted analog audio signal to the signal output portion 50.

The switch 34 receives the analog video signals supplied from both of the signal input portion 10 and the decoder 31*a* of the control portion 31 and switches the connection of signal lines to supply the entered signals to the video signal processing portion 32, sub-chroma decoder 35, analog-to-digital converter 36, and signal output portion 50.

The sub-chroma decoder 35 receives the video signals from the switch 34, selects those video signals in which the color-difference signals of Cr and Cb are quadrature-encoded out of the received video signals, quadrature-demodulates the selected video signals to digitize the analog signals quadrature-demodulated with respect to the color-difference signals, and supplies the digitized video signals to the video signal processing portion 32.

The analog-to-digital converter 36 digitizes the video signal supplied from the switch 34 and supplies the digitized video signal to the HDMI receiver 37. In the analog video signal supplied to the analog-to-digital converter 36, color-difference signals are not quadrature-encoded.

The HDMI receiver 37 receives the HDMI signal from the signal input portion 10, separates it into a digital video signal and a digital audio signal, and supplies the separated digital video signal to the video signal processing portion 32, and supplies the separated digital audio signal to the control portion 31. The HDMI receiver 37 switches the signal to be supplied to the video signal-processing portion 32 between the separated digital video signal and the digital video signal supplied from the analog-to-digital converter 36.

The backlight driving portion 38 creates a pulse-width modulated drive signal and supplies the drive signal to the backlight driving circuit 46 fitted in the display portion 40 (described later), thus controlling the operation of the backlight driving circuit 46.

The display portion 40 has an LCD panel 41 for displaying a video signal by applying voltages to electrodes disposed in the x- and y-directions of the xy orthogonal coordinate system, an x-electrode driver 42 for supplying a driver voltage to the x-direction electrodes of the LCD panel 41, a y-electrode driver 43 for supplying a drive voltage to the y-direction electrodes of the LCD panel 41, a driver control portion 44 for activating the x-electrode driver 42 and y-electrode driver 43 according to the video signal supplied from the image processing portion 30, the backlight 45 for illuminating the LCD panel 41 from the rear, and the backlight driving circuit 46 for supplying a driver voltage to the backlight 45.

The LCD panel 41 is an active-matrix panel in which electrodes are disposed, for example, in the x- and y-directions. Active elements corresponding to the pixels are formed at the intersections of the x- and y-electrodes.

The x-electrode driver 42 applies a drive voltage to the electrodes arrayed in the x-direction of the LCD panel 41.

The y-electrode driver 43 applies a drive voltage to the electrodes arrayed in the y-direction of the LCD panel 41.

The driver control portion 44 operates the x-electrode driver 42 and y-direction driver 43 in response to the video signal supplied from the image processing portion 30.

The backlight 45 is an illumination device disposed below the LCD panel 41. The backlight includes cold cathode fluorescent lamps (CCFLs) disposed parallel to the LCD panel 41.

The backlight driving circuit 46 supplies a drive voltage to the cold cathode fluorescent lamps of the backlight 45.

The signal output portion 50 has an audio output portion 51 for performing given processing on the analog audio signal entered from the signal input portion 10, a phono amplifier 52 for amplifying the analog audio signal outputted from the audio output portion 51, a power amplifier 53 for amplifying the analog audio signal outputted from the audio output portion 51, a loudspeaker 54 for producing audible sound from the analog audio signal amplified by the power amplifier 53, a recording output terminal 55 for outputting a video signal including an analog video signal and an analog audio signal to the outside, an analog audio output terminal 56 for outputting the analog audio signal from the audio output portion 51 to the outside, a digital audio signal output terminal 57 for outputting the digital audio signal coming from the audio output portion 51 to the outside, and a phono output terminal 58 for outputting the analog audio signal amplified by the phono amplifier 52 to the outside.

The audio output portion 51 receives the analog audio signals supplied from the signal input portion 10 and the digital-to-analog converter 33 of the image processing portion 30 and switches the connection of signal lines for supplying the received signals to the output terminals. In particular, the audio output portion 51 supplies the analog audio signal to the phono amplifier 52, power amplifier 53, recording output terminal 55, and analog audio output terminal 56, and supplies the digital audio signal to the digital audio output terminal 57.

The phono amplifier 52 amplifies the analog audio signal outputted from the audio output portion 51 and outputs the amplified signal to the outside from the phono output terminal 58.

The power amplifier 53 amplifies the analog audio signal outputted from the audio output portion 51 and supplies the amplified signal to the loudspeaker 54.

The loudspeaker 54 produces audible sound in response to the analog audio signal supplied from the power amplifier 53.

The recording output terminal 55 is a connector terminal permitting the analog audio signal supplied from the audio output portion 51 and the analog video signal supplied from the video signal processing portion 30 to be outputted to the outside, for example, as analog video signals for recording.

The analog audio output terminal 56 is a connector terminal permitting the analog audio signal supplied from the audio output portion 51 to be outputted to the outside.

The digital audio output terminal 57 is a connector terminal permitting the digital audio signal supplied from the audio output portion 51 to be outputted to the outside. For example, the outputted signal is a light signal.

The phono output terminal 58 is a connector terminal permitting the audio signal supplied from the phono amplifier 52 to be outputted to the outside.

Processing for driving the backlight 45 is next described.

Figure 2:
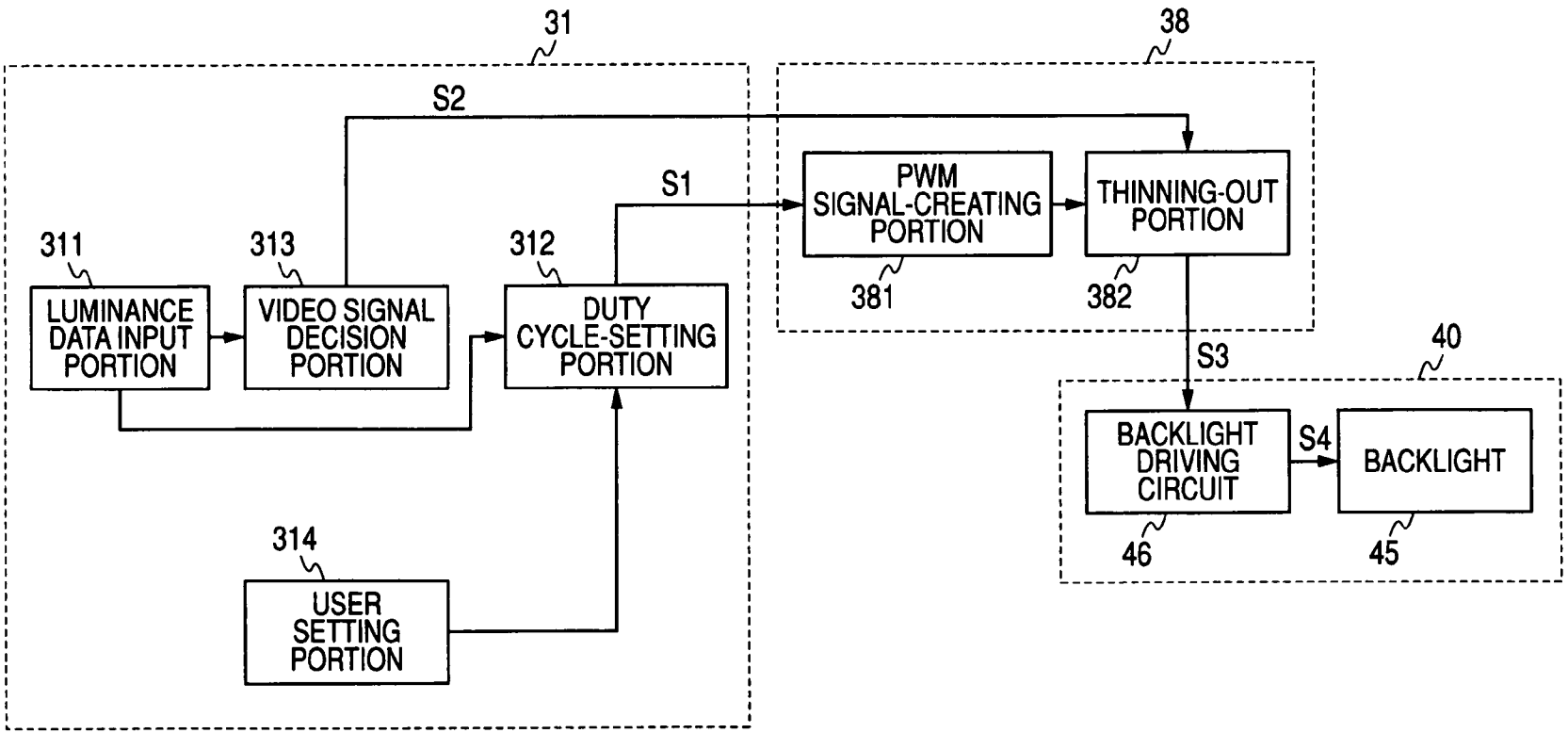
FIG. 2 is a block diagram showing a configuration for driving a backlight, the configuration being equipped in a liquid crystal display to which one embodiment of the invention is applied.

FIG. 2 is a schematic block diagram showing the configuration of the processing system of the above-described LCD 1 which is associated especially with the operation for driving the backlight 45.

The control portion 31 of the image processing portion 30 has the above-described decoder 31*a*. In addition, the control portion 31 has a luminance data input portion 311 for receiving luminance data included in a video signal, a duty cycle-setting portion 312 for setting the duty cycle of a PWM signal created by the backlight driving portion 38 according to the value indicated by the luminance data entered into the luminance data input portion 311, a video signal decision portion 313 for making a given decision according to the value indicated by the luminance data entered into the luminance data input portion 311, and a user setting portion 314 to which setting information about the operation of the duty cycle-setting portion 312 is supplied via a user interface.

Luminance data included in the video signal decrypted by the decoder 31*a* and luminance data included in the video signal processed by the video signal processing portion 32 are entered into the luminance data input portion 311. The input portion 311 supplies the entered luminance data to the duty cycle-setting portion 312 and the video signal decision portion 313.

The duty cycle-setting portion 312 creates a duty cycle-setting signal S1 for setting the duty cycle of a pulsed signal created by the backlight driving portion 38 according to the luminance data supplied from the luminance data input portion 311. Specifically, the duty cycle-setting portion 312 creates the duty cycle-setting signal S1 that sets the duty cycle of the PWM signal created by the backlight driving portion 38 as the luminance value included in the luminance data is increased.

That is, the duty cycle-setting portion 312 sets the duty cycle between Dmin and Dmax, where Dmin and Dmax are nonzero effective values. The duty cycle-setting portion 312 sets the duty cycle to Dmin when the value indicated by the luminance data is at minimum and sets the duty cycle to Dmax when the value indicated by the luminance data is at maximum. If the value indicated by the luminance data is small, the duty cycle is not set to 0 by the duty cycle-setting portion 312, for the following reason. If the backlight 45 is ceased to be applied with a voltage for more than a given time, and if one tries to drive the backlight 45 by subsequently creating a pulsed signal having an effective duty cycle, there is the danger that the backlight 45 is not lit up due to the dead band characteristics. This depends on general temperature characteristics of the backlight. The state in which the backlight is not lit up is prevented taking account of such dead band characteristics. Therefore, a related-art backlight-driving system is so designed that a voltage is typically always applied to the backlight, for example, at every PWM period even when an ineffective video signal having a luminance value of 0 at all times is displayed.

The video signal decision portion 313 makes a decision as to whether an effective video signal is entered from the signal input portion 10 to the image processing portion 30 according to whether the value indicated by the luminance data supplied from the luminance data input portion 311 is smaller than a given threshold value. For example, when the average of values indicated by the luminance data about individual frames is smaller than the given threshold value, the video signal decision portion 313 determines that the video signal is not effective. When the average of values indicated by the luminance data about individual frames taken over plural frames is smaller than a given threshold value, the video signal decision portion 313 may determine that the video signal is not effective. The video signal decision portion 313 supplies a decision signal S2 according to the result of the decision to the backlight driving portion 38.

Setting information regarding the operation of the duty cycle-setting portion 312 is supplied to the user setting portion 314 via the user interface (not shown). Specifically, a value about a threshold value about the processing performed by the video signal decision portion 313 is supplied as the setting information from the user interface to the user setting portion 314. The setting information concerning the threshold value is supplied to the video signal decision portion 313.

The backlight driving portion 38 has a PWM signal-creating portion 381 for creating a PWM signal according to the duty cycle-setting signal S1 supplied from the control portion 31 and a thinning-out portion 382 for thinning out pulses forming the PWM signal created by the PWM signal-creating portion 381 according to the decision signal S2 supplied from the control portion 31.

The PWM signal-creating portion 381 is a signal-generating circuit having a fixed PWM period, and creates a PWM signal corresponding to the duty cycle-setting signal S1 supplied from the control portion 31. That is, the PWM signal-creating portion 381 creates a PWM signal made of pulses having a duty cycle corresponding to the duty cycle-setting signal S1 and supplies the created PWM signal to the thinning-out portion 382. Because the duty cycle set by the duty cycle-setting signal is between Dmin to Dmax, the PWM signal-creating portion 381 creates a drive signal made of pulses which are pulse width-modulated so as to have an effective duty cycle over the whole PWM period. In the present embodiment, it is assumed, for example, that the PWM frequency is 150 Hz.

The thinning-out portion 382 thins out the pulses forming the PWM signals created by the PWM signal-creating portion 381 according to the decision signal S2 supplied from the control portion 31. In particular, if the video signal decision portion 313 of the control portion 31 has determined that the video signal is ineffective and correspondingly the decision signal S2 is outputted, and if the backlight 45 is attempted to be driven by supplying a signal having an effective duty cycle, then the thinning-out portion 382 supplies the drive signal S3 to the backlight driving circuit 46, the signal S3 being made up of pulses which form the PWM signal and which have been thinned out in such an extent as to prevent the danger that the backlight is not lit up. Meanwhile, if the video signal decision portion 313 of the control portion 31 has determined that the video signal is effective and correspondingly the decision signal S2 is supplied, the thinning-out portion 382 supplies the drive signal S3 to the backlight driving circuit 46 without thinning out the pulses forming the PWM signal.

The backlight driving circuit 46 applies a drive voltage S4 to the backlight 45, the voltage S4 being pulse number-modulated according to the drive signal S3 supplied from the backlight driving portion 38. The frequency of the drive voltage S4 created by the backlight driving circuit 46 is set much higher than the PWM frequency of the drive signal created by the backlight driving circuit 38. In the present embodiment, the frequency is set to 50 kHz, for example.

The backlight 45 lights up the cold cathode fluorescent lamps in response to the drive voltage S4 supplied from the backlight driving circuit 46 to illuminate the rear surface of the LCD panel 41.

In the present embodiment, the functions associated with the luminance data input portion 311, duty cycle-setting portion 312, video signal decision portion 313, and user setting portion 314 are incorporated on a processor that realizes the control portion 31. The present embodiment is not limited to this configuration. The functions may also be incorporated, for example, in the backlight driving portion 38.

The operation of the backlight 45 that becomes different according to the state of the video signal is described by referring to FIG. 3, where the relationship between the drive signal S3 created by the backlight driving portion 38 and the drive voltage S4 created by the backlight driving circuit 46 is shown.

Figures 3A, 3B, 3C:
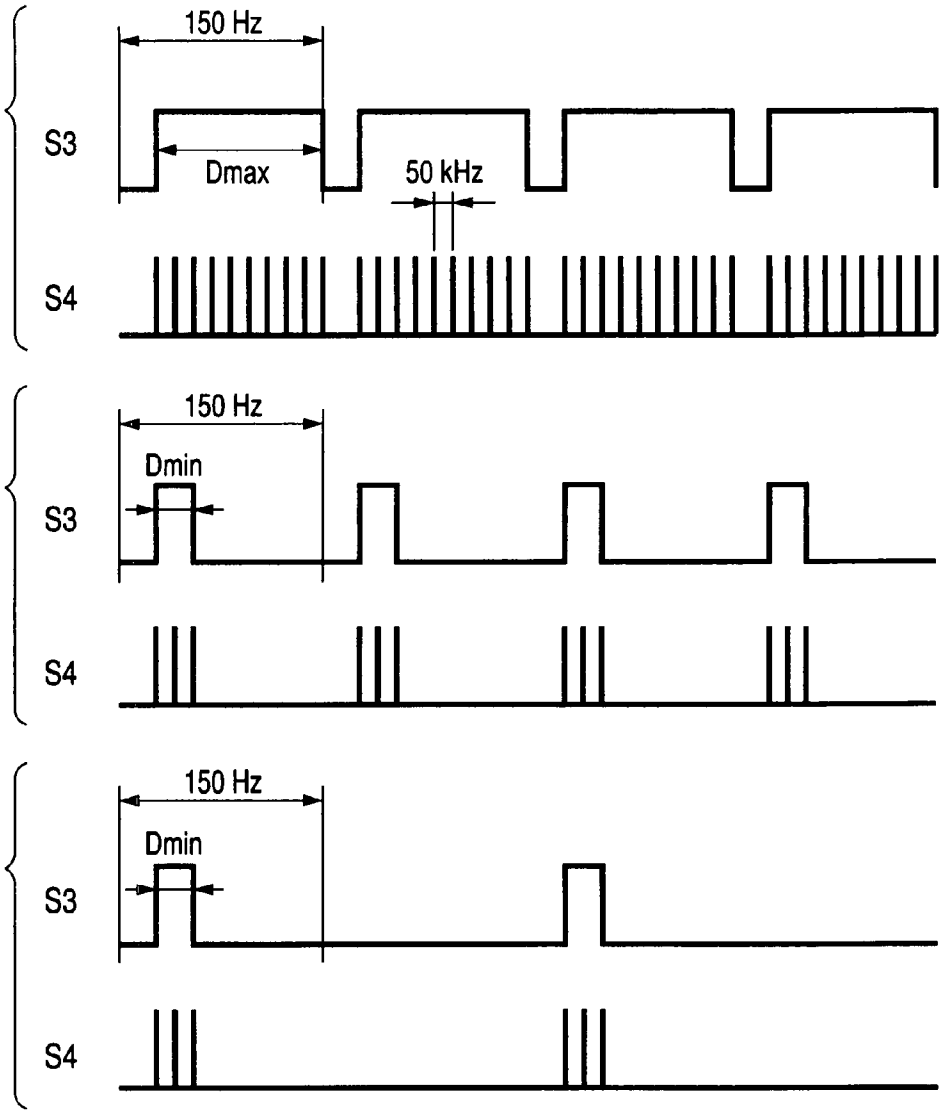
FIGS. 3A to 3C are diagrams illustrating a drive signal used for driving a backlight.

FIG. 3A is a graph showing the drive signal S3 and drive voltage S4 under the condition where a video signal, for example, having luminance data indicating a very high average luminance value is displayed on the LCD panel 41.

At this time, the duty cycle-setting portion 312 creates a duty cycle-setting signal for setting the duty cycle to Dmax, for example, because the average luminance value indicated by the luminance data is very high. The created signal is supplied to the PWM signal-creating portion 381. Because the average luminance value indicated by the luminance data is very high, the video signal decision portion 313 determines that the video signal is effective. The decision portion 313 supplies the decision signal S2 corresponding to the result of the decision to the thinning-out portion 382.

Therefore, the PMW signal-creating portion 381 creates a pulsed signal having a duty cycle of Dmax and supplies the signal to the thinning-out portion 382, which in turn supplies the drive signal S3 (FIG. 3A) whose pulses are not thinned out according to the decision signal S2 to the backlight driving circuit 46.

The backlight driving circuit 46 applies the drive voltage S4 to the backlight 45, the voltage S4 being made of a pulsed signal that is PNM-modulated according to the drive signal S3 supplied from the backlight driving portion 38.

FIG. 3B is a diagram showing drive signal S3 and drive voltage S4 under the condition, for example, where the video signal having luminance data whose average luminance value is relatively low is displayed on the LCD panel 41.

At this time, the average luminance value of the luminance data is relatively low and so the duty cycle-setting portion 312 creates the duty cycle-setting signal S1 for setting the duty cycle, for example, to Dmin and supplies the signal S1 to the PWM signal-creating portion 381. The video signal decision portion 313 determines that the average luminance value of the luminance data is relatively low but the video signal is effective, and supplies the decision signal S2 corresponding to the result of the decision to the thinning-out portion 382.

Therefore, the PWM signal-creating portion 381 creates a pulsed signal having a duty cycle of Dmin and supplies the created signal to the thinning-out portion 382. The thinning-out portion 382 supplies the drive signal S3 shown in FIG. 3B, whose pulses are not thinned out according to the decision signal S2, to the backlight driving circuit 46.

The backlight driving circuit 46 applies the drive voltage S4 made of a pulsed signal, which is PNM-modulated according to the drive signal S3 supplied from the backlight driving portion 38, to the backlight 45.

FIG. 3C is a diagram showing the drive signal S3 and drive voltage S4 under the state in which the video signal having no effective luminance value is displayed on the LCD panel 41.

Because the average luminance value of the luminance data is relatively low, the duty cycle-setting portion 312 creates the duty cycle-setting signal S1 for setting the duty cycle, for example, to Dmin and supplies the created signal to the PWM signal-creating portion 381. The video signal decision portion 313 determines that the video signal is not effective, and supplies the decision signal S2 corresponding to the result of the decision to the thinning-out portion 382.

Consequently, the PWM signal-creating portion 381 creates a pulsed signal having a duty cycle of Dmin and supplies the signal to the thinning-out portion 382. The thinning-out portion 382 supplies the drive signal S3, whose pulses are thinned out at every PWM period as shown in FIG. 3C according to the decision signal S2, to the backlight driving circuit 46. The thinning-out portion 382 thins out the pulses at every PWM period as a specific example. The invention is not limited to this example. The thinning-out portion may thin out more pulses at regular intervals of time to such an extent as to prevent the danger that the backlight is not lit up when the backlight 45 is attempted to be driven by supplying a signal having an effective duty cycle.

The backlight driving circuit 46 applies the drive voltage S4 made of a pulsed signal, which is PNM-modulated according to the drive signal S3 supplied from the backlight driving portion 38, to the backlight 45.

In this way, in the LCD 1, when the video signal decision portion 313 has determined that the value indicated by the entered luminance data is smaller than a given value, the thinning-out portion 382 thins out pulses forming the PWM signal, and the backlight driving circuit 46 applies the drive voltage S4 corresponding to the drive signal S3 to the backlight 45. In consequence, electric power consumed when an ineffective video signal is displayed on the LCD panel 41 can be reduced.

The drive signal S3 as shown in FIG. 3C can be created, for example, by doubling the PWM period of the PWM signal-creating portion. In contrast, in the LCD 1, the PWM period of the PWM signal-creating portion 381 is fixed. Accordingly, the backlight driving portion 38 associated with the present embodiment creates a similar signal without using a PWM signal-creating signal whose PWM period is variable. Hence, increase in circuit scale of the drive circuit that would otherwise be caused by using a PWM signal-creating circuit having a variable PWM period is suppressed. As a result, the power consumption can be reduced as mentioned previously.

It should be understood by those skilled in the art that various modifications, combinations, sub-combinations and alterations may occur depending on design requirements and other factors insofar as they are within the scope of the appended claims or the equivalents thereof.

What is claimed is:

1. A backlight driving device for driving a backlight that illuminates a display panel, the backlight driving device comprising:

a luminance data input device into which luminance data indicated by a video signal is entered;

a duty cycle setting device configured to create a duty cycle setting signal based on values of the luminance data entered into the luminance data input device, in which the duty cycle setting signal indicates a duty cycle set between a minimum value and a maximum value in which both the minimum value and the maximum value are nonzero values;

a drive signal-generating device configured to create a drive signal made of a signal which is pulse width-modulated so as to have the duty cycle according to the duty cycle setting signal such that the duty cycle is associated with a whole period, a driving circuit configured to supply power to the backlight according to the drive signal created by the drive signal-generating device so as to drive the backlight;

a video signal decision device configured to make a decision as to whether each value of the luminance data entered into the luminance data input device is smaller than a given value to determine if the video signal is not an effective signal or higher than the given value to determine if the video signal is an effective signal; and a thinning-out device configured to (i) thin out components of the drive signal created by the drive signal- generating device when the video signal decision device has determined that the video signal is not an effective signal and when the duty cycle setting signal created by the duty cycle setting device indicates that the duty cycle has a low value and supply the thinned drive signal to the driving circuit, (ii) not thin out components of the drive signal created by the drive signal-generating device so as to maintain the created duty cycle when the video signal decision device has determined that the video signal is an effective signal and when the duty cycle setting signal created by the duty cycle setting device indicates that the duty cycle has a low value and supply the drive signal to the driving circuit, and (iii) not thin out components of the drive signal created by the drive signal-generating device so as to maintain the created duty cycle when the video signal decision device has determined that the video signal is an effective signal and when the duty cycle setting signal created by the duty cycle setting device indicates that the duty cycle has a high value and supply the drive signal to the driving circuit.

2. A backlight driving device as set forth in claim 1, wherein the drive signal-generating device creates the drive signal made of a signal that is pulse width-modulated such that its duty cycle increases with increasing the value of the luminance data entered into the luminance data input device.

3. A display device for displaying a video signal on a display panel, the display device comprising:

a video signal-accepting device configured to accept the video signal;

a video processing device configured to display the video signal accepted by the video signal-accepting device onto the display panel;

a backlight configured to illuminate the display panel; and a backlight driving device configured to drive the backlight;

wherein the backlight driving device has:

a duty cycle setting device configured to create a duty cycle setting signal based on values of the luminance data entered into the luminance data input device, in which the duty cycle setting signal indicates a duty cycle set between a minimum value and a maximum value in which both the minimum value and the maximum value are nonzero values;

a drive signal-generating device configured to create a drive signal made of a signal which is pulse width-modulated so as to have the duty cycle according to the duty cycle setting signal such that the duty cycle is associated with a whole period, a driving circuit configured to supply power to the backlight according to the drive signal created by the drive signal-generating device so as to drive the backlight, a video signal decision device configured to make a decision as to whether each value of the luminance data entered into the video data input device is smaller than a given value to determine if the video signal is not an effective signal or higher than the given value to determine if the video signal is an effective video signal, and a thinning-out device configured to (i) thin out components of the drive signal created by the drive signal-generating device when the video signal decision device has determined that the video signal is not an effective signal and when the duty cycle setting signal created by the duty cycle setting device indicates that the duty cycle has a low value and supply the thinned drive signal to the driving circuit, (ii) not thin out components of the drive signal created by the drive signal-generating device so as to maintain the created duty cycle when the video signal decision device has determined that the video signal is an effective signal and when the duty cycle setting signal created by the duty cycle setting device indicates that the duty cycle has a low value and supply the drive signal to the driving circuit, and (iii) not thin out components of the drive signal created by the drive signal-generating device so as to maintain the created duty cycle when the video signal decision device has determined that the video signal is an effective signal and when the duty cycle setting signal created by the duty cycle setting device indicates that the duty cycle has a high value and supply the drive signal to the driving circuit.

4. A display device as set forth in claim 3, wherein the drive signal-generating device creates a drive signal made of a signal that is pulse-width modulated so as to increase its duty cycle with increasing the value of the luminance data entered into the luminance data input device.

5. A backlight driving device for driving a backlight that illuminates a liquid crystal display panel, the backlight driving device comprising:

a luminance data input means into which luminance data indicated by a video signal to be displayed on the liquid crystal display panel is entered;

a duty cycle setting means for creating a duty cycle setting signal based on values of the luminance data entered into the luminance data input device, in which the duty cycle setting signal indicates a duty cycle set between a minimum value and a maximum value in which both the minimum value and the maximum value are nonzero values;

a drive signal-generating means for creating a drive signal made of a pulsed signal which is pulse width-modulated so as to have the duty cycle according to the duty cycle setting signal such that the duty cycle is associated with a whole period a driving circuit means for supplying power to the backlight according to the drive signal created by the drive signal-generating means so as to drive the backlight;

a video signal decision means for making a decision as to whether each value of the luminance data entered into the luminance data input means is smaller than a given value to determine if the video signal is not an effective signal or higher than the given value to determine if the video signal is an effective video signal; and a thinning-out means for (i) thinning out pulses forming the drive signal created by the drive signal-generating device when the video signal decision device has determined that the video signal is not an effective signal and when the duty cycle setting signal created by the duty cycle setting means indicates that the duty cycle has a low value and supplying the thinned drive signal to the driving circuit means, (ii) not thin out components of the drive signal created by the drive signal-generating means so as to maintain the created duty cycle when the video signal decision means has determined that the video signal is an effective signal and when the duty cycle setting signal created by the duty cycle setting means indicates that the duty cycle has a low value and supply the drive signal to the driving circuit means, and (iii) not thin out components of the drive signal created by the drive signal-generating means so as to maintain the created duty cycle when the video signal decision means has determined that the video signal is an effective signal and when the duty cycle setting signal created by the duty cycle setting means indicates that the duty cycle has a high value and supply the drive signal to the driving circuit means.

6. A backlight driving device as set forth in claim 5, wherein the drive signal-generating means creates the drive signal made of a pulsed signal that is pulse width-modulated such that its duty cycle increases with increasing the value of the luminance data entered into the luminance data input means.

7. A liquid crystal display for displaying a video signal on a liquid crystal display panel, the liquid crystal display comprising:

a video signal-accepting means for accepting the video signal;

a video processing means for displaying the video signal accepted by the video signal-accepting means onto the liquid crystal display panel;

a backlight which illuminates the liquid crystal display panel; and a backlight driving device for driving the backlight;

wherein the backlight driving device has:

a duty cycle setting means for creating a duty cycle setting signal based on values of the luminance data entered into the luminance data input device, in which the duty cycle setting signal indicates a duty cycle set between a minimum value and a maximum value in which both the minimum value and the maximum value are nonzero values;

a drive signal-generating means for creating a drive signal made of a pulsed signal which is pulse width-modulated so as to have the duty cycle according to the duty cycle setting signal such that the duty cycle is associated with a whole period, a driving circuit means for supplying power to the backlight according to the drive signal created by the drive signal-generating means so as to drive the backlight, a video signal decision means for making a decision as to whether each value of the luminance data indicated by the video signal accepted by the video signal-accepting means is smaller than a given value to determine the video signal is not an effective signal or higher than the given value to determine whether the video signal is an effective signal, and a thinning-out means for (i) thinning out pulses forming the drive signal created by the drive signal-generating means when the video signal decision device has determined that the video signal is not an effective signal and when the duty cycle setting signal created by the duty cycle setting means indicates that the duty cycle has a low value and supplying the thinned drive signal to the driving circuit means, (ii) not thin out components of the drive signal created by the drive signal-generating means so as to maintain the created duty cycle when the video signal decision means has determined that the video signal is an effective signal and when the duty cycle setting signal created by the duty cycle setting means indicates that the duty cycle has a low value and supply the drive signal to the driving circuit means, and (iii) not thin out components of the drive signal created by the drive signal-generating means so as to maintain the created duty cycle when the video signal decision means has determined that the video signal is an effective signal and when the duty cycle setting signal created by the duty cycle setting means indicates that the duty cycle has a high value and supply the drive signal to the driving circuit means.

* * * * *